US005518648A

United States Patent [19]

Welch et al.

[11] Patent Number: 5,518,648

[45] Date of Patent: May 21, 1996

[54] SOLID DISHWASHING COMPOSITION COMPRISING A TWO-COMPONENT BLEND OF ALKOXYLATED NONIONIC SURFACTANTS

[75] Inventors: Michael C. Welch, Woodhaven; Kenneth L. Zack, Wyandotte; Suzanne M. Gessner, Ypsilanti; Glenis Roberts, Wyandotte, all of Mich.

[73] Assignee: BASF Corporation, Parsippany, N.J.

[21] Appl. No.: 261,145

[22] Filed: Jun. 14, 1994

[51] Int. Cl.[6] ..... C11D 1/825; C11D 3/395; C11D 3/48

[52] U.S. Cl. ..... 252/174.22; 252/94; 252/99; 252/106; 252/174.21; 252/DIG. 1; 252/DIG. 10

[58] Field of Search ..... 252/174.22, 174.21, 252/DIG. 1, DIG. 10, 94, 99, 106; 568/624, 622, 625

[56] References Cited

U.S. PATENT DOCUMENTS

| | | | |
|---|---|---|---|
| 2,674,619 | 4/1954 | Lundsted | 560/198 |
| 4,187,190 | 2/1980 | McLaughlin et al. | 252/99 |
| 4,226,736 | 11/1980 | Bush et al. | 252/135 |
| 4,233,171 | 11/1980 | McLaughlin et al. | 252/99 |
| 4,233,172 | 11/1980 | McLaughlin et al. | 252/99 |
| 4,272,394 | 6/1981 | Kaneko | 252/99 |
| 4,306,987 | 12/1981 | Kaneko | 252/99 |
| 4,411,810 | 10/1983 | Dutton et al. | 252/99 |
| 4,438,014 | 3/1984 | Scott | 252/174.21 |

*Primary Examiner*—Paul Lieberman
*Assistant Examiner*—A. Hertzog
*Attorney, Agent, or Firm*—Burns, Doane, Swecker & Mathis

[57] ABSTRACT

A machine dishwashing composition is provided wherein two specifically defined nonionic surfactants are utilized which in combination have been shown through empirical research to surprisingly yield improved results. One of the nonionic surfactants is an alcohol alkoxylate (as defined) and the other nonionic surfactant is a block copolymer of ethylene oxide and propylene oxide (as defined). The use temperature for efficient cleaning while using the composition extends over a broad range up to at least 140° F. in the absence of deleterious foaming even in the presence of protein soil (e.g., egg and/or milk soil).

22 Claims, No Drawings

SOLID DISHWASHING COMPOSITION COMPRISING A TWO-COMPONENT BLEND OF ALKOXYLATED NONIONIC SURFACTANTS

BACKGROUND OF THE INVENTION

Machine dishwashing compositions comprising one or more nonionic surfactants long have been known and are commercially available. For optimum results the detergent composition should be capable of adequate soil removal when used under the varied conditions commonly encountered by the consumer in a typical household machine dishwasher. The operating conditions commonly encountered in household dishwashers used by the public frequently encompass a range of diverse operating temperatures that often are influenced by the temperature of the water currently being supplied by the household hot-water heater for the diverse hot-water requirements of the home. At a time of high demand for hot water within the household, the water temperature may be considerably lower than when there is no competition for the finite supply of hot water. It further is recognized that optimum soil removal commonly is achieved at higher water temperatures. Additionally, it is recognized that certain types of soils, such as protein soil from eggs and/or milk products, in conjunction with the detergent, can enhance the generation of harmful quantities of foam within the dishwasher that serve to impede the removal of soil from dishes by reducing the impact of a stream of water thrown by the spray arm or impeller of the dishwasher.

Representative nonionic surfactants for use in machine dishwashing compositions are disclosed in U.S. Pat. Nos. 4,306,987; 4,411,810; and 4,438,014. Additionally, commonly assigned U.S. Pat. No. 4,272,394 discloses a surfactant composition comprising a blend of nonionic surfactants.

Commonly assigned U.S. patent application Ser. No. 08/261,144 to the same inventors as named herein, entitled "Improved Rinse-Aid Composition Comprising a Blend of Nonionic Surfactants" is filed concurrently herewith.

It is an object of the present invention to provide an improved aqueous machine dishwashing composition that exhibits good soil removal properties and effective protein soil defoaming over an expanded range of operating temperatures.

It is an object of the present invention to provide an improved aqueous machine dishwashing composition that is suitable for use at a temperature of up to at least 140° F. in the absence of deleterious foaming even in the presence of protein soil sometimes encountered during the washing of household dishes.

It is an object of the present invention to provide an improved aqueous machine dishwashing composition that in a preferred embodiment is free of an alkyl phosphate ester defoamer.

These and other objects and advantages of the claimed invention will be apparent to those skilled in the art from the following detailed description and appended claims.

SUMMARY OF THE INVENTION

It has been found that an improved machine dishwashing composition suitable for use in water at a temperature of up to at least 140° F. in the absence of excessive foaming even in the presence of protein soil consists essentially approximately 1 to 10 percent by weight based upon the total weight of the composition of a blend of nonionic surfactants (i) and (ii), wherein (i) is an alcohol alkoxylate surfactant having a molecular weight of approximately 500 to 2,000 and the structural formula:

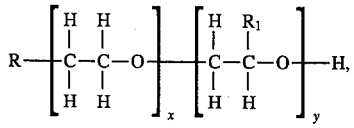

wherein R is an alkyl group of 6 to 18 carbon atoms, $R_1$ is a methyl group or an ethyl group, x is at least 3, and y is at least 2, and (ii) is a block copolymer of ethylene oxide and propylene oxide having a molecular weight of approximately 2,000 to 5,000 and the structural formula:

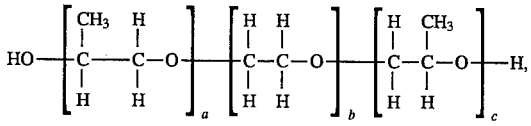

wherein a+c equals at least 20, and b is at least 20; approximately 10 to 90 percent by weight based upon the total weight of the composition of at least one builder detergent; and approximately 0.5 to 50 percent by weight based upon the total weight of the composition of at least one compound containing active chlorine or available oxygen, All weight percentages expressed herein are based upon the total weight of nonaqueous components present in the composition unless otherwise expressed.

DETAILED DESCRIPTION

The machine dishwashing composition of the present invention includes a blend of two specifically defined nonionic surfactants that through empirical research has been found to yield surprisingly advantageous dishwashing results wherein there is an absence of excessive foaming even at elevated use temperatures as discussed in detail hereafter.

The first nonionic surfactant (i) is an alcohol alkoxylate having a molecular weight of approximately 500 to 2,000 (preferably 1,200 to 1,600) and the structural formula A:

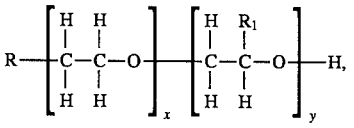

wherein R is an alkyl group of 6 to 18 (preferably 8 to 10) carbon atoms, $R_1$ is a methyl group or an ethyl group, x is at least 3 (e.g., 3 to 12), and y is at least 2 (e.g., 2 to 18).

The alkyl groups R of nonionic surfactant (i) can be branched- or straight-chained. Representative examples of preferred alkyl groups include hexyl, octyl, decyl, dodecyl, and mixtures of these.

The recurring oxyethylene units in nonionic surfactant (i) designated by x are derived from ethylene oxide and impart hydrophilic moieties to the surfactant. The recurring units y are derived from propylene oxide and/or butylene oxide and impart hydrophobic moieties to the surfactant. In a preferred embodiment $R_1$ is methyl and the recurring units y are derived exclusively from propylene oxide.

The nonionic surfactant (i) can be formed by known techniques wherein a monofunctional initiator (e.g., a monohydric alcohol, such as octyl alcohol and/or decyl alcohol) from which the R portion of the surfactant molecule is derived is first reacted with ethylene oxide and subsequently with propylene oxide and/or butylene oxide. The recurring units x and y commonly are selected so that the weight of the oxyethylene units x constitutes approximately 25 to 45 percent by weight based upon the total weight of nonionic surfactant (i). In a preferred embodiment the recurring units x and y are selected so that the weight of the oxyethylene units x constitutes approximately 30 percent by weight based upon the total weight of nonionic surfactant (i).

Nonionic surfactant (i) preferably exhibits a cloud point of no more than approximately 20° C. (e.g., approximately 10° to 20° C.). Such cloud point conveniently can be determined while observing a 1 weight percent aqueous solution of the surfactant in accordance with conventional procedures.

The second nonionic surfactant (ii) is a block copolymer of ethylene oxide and propylene oxide having a molecular weight of approximately 2,000 to 5,000 (preferably 3,000 to 4,000) and the structural formula B:

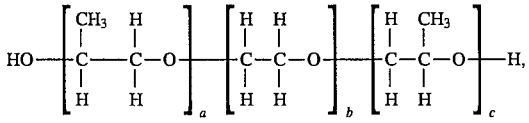

wherein the outermost blocks of the surfactant structure are derived from propylene oxide and are hydrophobic in nature, and the central block is derived from ethylene oxide and is hydrophilic in nature. In the structural formula a+c equals at least 20 (e.g., 20 to 40, and preferably 25 to 36), and b is at least 20 (e.g., 20 to 35, and preferably 22 to 32). In the structural formula a and c individually commonly are at least 10. In a particularly preferred embodiment a and c are substantially equal. Also, in a preferred embodiment the units b derived from ethylene oxide of the nonionic surfactant (ii) are present in a concentration of approximately 30 to 50 (e.g., 40) percent by weight based upon the total weight of nonionic surfactant (ii).

The nonionic surfactant (ii) can be formed by conventional techniques, such as that described in commonly assigned U.S. Pat. No. 2,674,619. Ethylene oxide can be added to ethylene glycol to provide a hydrophile of the desired molecular weight, and propylene oxide can next be added to obtain hydrophobic blocks at each end of the nonionic surfactant molecule.

Nonionic surfactant (ii) preferably exhibits a cloud point of approximately 30° to 50° C. Such cloud point conveniently can be determined while observing a 1 weight percent aqueous solution of the surfactant in accordance with conventional procedures.

The machine dishwashing composition of the present invention commonly contains a weight concentration of nonionic surfactant (i) to nonionic surfactant (ii) in the blend of nonionic surfactants of approximately 3 to 5:1, and preferably approximately 4:1. During the marketing and shipment of the surfactants, the surfactant blend conveniently can be provided as a concentrated aqueous solution wherein the nonionic surfactants (i) and (ii) are provided in a combined concentration of approximately 80 percent or more by weight. In a further embodiment the dishwashing composition conveniently can be marketed as a free-flowing granular product that includes nonionic surfactants (i) and (ii). Alternatively, the surfactants can be individually obtained and combined with the other ingredients of the dishwashing composition when added to the machine dishwasher.

The dishwashing composition of the present invention commonly contains the blend of nonionic surfactants (i) and (ii) in a combined concentration of approximately 1 to 10 percent by weight based upon the total weight of nonaqueous components, and preferably surfactants (i) and (ii) are present in a combined concentration of approximately 1 to 6 percent by weight based upon the total weight of nonaqueous components. When a phosphate builder detergent is present in the composition, a combined concentration of nonionic surfactants (i) and (ii) of approximately 1 to 3 percent by weight based upon the total weight of the nonaqueous components commonly is utilized. When no phosphate builder detergent or a phosphate builder detergent is utilized in a low concentration, a combined concentration of nonionic surfactants (i) and (ii) of approximately 3 to 6 percent by weight based upon the total weight of the nonaqueous components commonly is utilized.

The machine dishwashing composition of the present invention contains approximately 10 to 90 (e.g., 40 to 85) percent by weight of at least one builder detergent that increases the effectiveness of the composition by acting as a softener, sequestering, and/or buffering agent. Commonly one utilizes a combination of builder detergents, such as those commonly employed in the prior art. Representative builder detergents include phosphates, silicates, polyacrylic acid, ethylenediaminetetraacetic acid, zeolites, starch derivatives, etc. Further examples of possible builder detergents for use in the machine dishwashing composition of the present invention include tetrasodium pyrophosphate, sodium tripolyphosphate, sodium carbonate, sodium bicarbonate, mixtures of di- and trisodium orthophosphate, sodium metasilicate, sodium sequisilicate, borax, sodium borate, organic sequestering agents such as ethylenediamine tetraacetates, water-soluble salts of citric acid, tetrasodium ethylene diamine tetraacetate, nitriloacetic acid, etc.

Additionally, the machine dishwashing composition of the present invention contains approximately 0.5 to 50 (e.g., 1 to 5) percent by weight of at least one compound containing active chlorine or available oxygen. Such compound imparts germicidal and bleaching action to the composition. Representative active-chlorine containing compounds include chlorinated trisodium phosphate, trichlorocyanuric acid, sodium trichloroisocyanurate, the sodium salt of dichlorocyanuric acid, the potassium salt of dichlorocyanuric acid, sodium hypochlorite, and 1,3-dichloro-5,5-dimethylhydantoin. The amount of active chlorine or available oxygen provided by each compound will vary as will be apparent to those skilled in the art and the concentration will be selected so as to provide sufficient germicidal bleaching activity. For instance, much higher amounts of active chlorine are provided by a given concentration of a salt of a chlorinated cyanuric acid than by chlorinated trisodium phosphate. Representative compounds for the supply of available oxygen include the conventional peroxygen bleaching compounds, such as sodium perborate, sodium percarbonate, etc.

Other auxiliary components commonly utilized in dishwashing compositions may optionally also be included in the aqueous machine dishwashing composition of the present invention so long as such ingredients do not interfere with the surprising benefits made possible by the blend of nonionic surfactants (i) and (ii) discussed herein. Such optional additional ingredients include fillers (e.g., sodium sulfate), colorants, fragrance-release agents, etc. In a preferred embodiment, a phosphate ester defoamer is absent in the dishwashing composition of the present invention.

The machine dishwasher composition of the present invention commonly is contacted with food-soiled utensils during use when present in an aqueous solution in a concentration of about 0.1 to about 1.5 (e.g., 0.2 to 1) percent by weight at an elevated water temperature.

The dishwashing composition of the present invention provides the user with good cleaning ability for soiled dishes over a broad range of operating conditions up to at least 140° F. For instance, satisfactory soil removal commonly is achieved at temperatures ranging from 80° F. up to at least 140° F. Even if protein-containing soil, such as that derived from eggs and/or milk products is encountered in the dishwasher, excessive foaming does not occur when utilizing the improved machine dishwashing composition of the present invention. Accordingly, excessive quantities of foam surprisingly are not generated even at elevated temperatures. If such excessive quantities of foam were present, they would inhibit the cleaning of dishes through the at least partial blockage of the action of the surfactant-containing stream of water that is directed by the dishwasher's spray arm or impeller to impact upon the exposed surfaces of the dishes that are intended to be washed. Also, effective foam control is maintained even at lower dishwashing temperatures. Additionally, no potentially harmful phosphate ester defoamers need be utilized in the machine dishwashing composition of the present invention.

The following Examples are presented as specific illustrations of the present invention. It should be understood, however, that the invention is not limited to the specific details set forth in the Examples. In the Examples and in the Comparative Examples dishes were washed in a standard Hobart UMP-4 commercial dishwasher while using various nonionic surfactants (identified hereafter) individually and when blended in accordance with the concept of the present invention. In some instances egg soil or milk soil was added. In each instance, the nonionic surfactant or nonionic surfactant blend was provided in a concentration of 3 percent by weight based upon the total weight of the inherently solid nonaqueous components of the dishwashing composition that was added to the water which circulated in the dishwasher during the wash cycle. Conventional builder salts in powder form were present in each instance (i.e., 44 percent by weight sodium tripolyphosphate, 20 percent by weight sodium carbonate, 20 percent by weight of sodium metasilicate), and a filler in powder form (i.e., 11.5 percent by weight sodium sulfate). Additionally, 1.5 percent by weight of sodium trichloroisocyanurate was present in each instance as an active chlorine-containing compound.

In each Example and Comparative Example the machine containing typical utensils (i.e., dishes, and flatware) was started and was allowed to fill partially with water, the machine was stopped, 20 grams of the dishwashing composition were added, and the machine was restarted and was allowed to fill completely. In some instances 15 grams of raw egg soil or 12 grams of milk soil also were added. The water temperature was provided at approximately 90° F. or at approximately 140° F. After the wash cycle was started, the spray arm rotation rate was measured and is expressed hereafter as a percentage relative to the rotation rate measured in water only. The foaming characteristics of the dishwashing composition were measured in each instance through an observation of the spray-arm rotation rate. Such spray-arm rotation rate was inversely proportional to the quantity of foam generated in the dishwasher. Excess foam interferes with satisfactory dishwashing.

Comparative Example 1

An alcohol alkoxylate nonionic surfactant was utilized having a molecular weight of approximately 1,400 that corresponded to structural formula A previously presented for a surfactant of this type wherein R was an alkyl group of 8 to 10 carbon atoms, $R_1$ was a methyl group, "x" was approximately 10, and "y" was approximately 14. Such surfactant exhibited a cloud point of 19° C. This composition was evaluated at 90° F. and 140° F.

Comparative Example 2

Example 1 was repeated with the exception that an alcohol alkoxylate surfactant was utilized having a molecular weight of 600 that corresponded to structural formula A previously presented for a surfactant of this type wherein R was an alkyl group of 10 to 14 carbon atoms, $R_1$ was an ethyl group, "x" was approximately 5, and "y" was approximately 2. This composition was evaluated at 90° F. and 140° F.

Comparative Example 3

Example 1 was repeated with the exception that an alcohol alkoxylate surfactant was utilized having a molecular weight of 1,800 that corresponded to structural formula A previously presented for a surfactant of this type wherein R was an alkyl group of 6 to 10 carbon atoms, $R_1$ was a methyl group, "x" was approximately 12, and "y" was approximately 18. This composition was evaluated at 90° F. and 140° F.

Comparative Example 4

Example 1 was repeated with the exception that a block copolymer nonionic surfactant of ethylene oxide and propylene oxide having a molecular weight of approximately 3,000 was utilized that corresponded to structural formula B previously presented for a surfactant of this type wherein a+c was approximately 31, and b was approximately 27. Such surfactant exhibited a cloud point of 40° C. This composition was evaluated at 90° F.

Comparative Example 5

Example 1 was repeated with the exception that a block copolymer nonionic surfactant of ethylene oxide and propylene oxide having a molecular weight of approximately 3,200 was utilized that corresponded to structural formula B previously presented for a surfactant of this type wherein a+c was approximately 33, and b was approximately 29. Such surfactant exhibited a cloud point of 40° C. This composition was evaluated at 90° F.

Comparative Example 6

Example 1 was repeated with the exception that a block copolymer nonionic surfactant of ethylene oxide and propylene oxide having a molecular weight of approximately 3,500 was utilized that corresponded to structural formula B previously presented for a surfactant of this type wherein a+c was approximately 36, and b was approximately 32. Such surfactant exhibited a cloud point of 31° C. This composition was evaluated at 90° F.

Example 7

Example 1 was repeated with the exception that the surfactant was a blend of alcohol alkoxylate surfactant of Example 1 and the block copolymer nonionic surfactant of ethylene oxide and propylene oxide of Example 4. The weight ratio of the nonionic surfactant of Example 1 to that of Example 4 was 4:1.

Example 8

Example 1 was repeated with the exception that the surfactant was a blend of alcohol alkoxylate surfactant of Example I and the block copolymer nonionic surfactant of ethylene oxide and propylene oxide of Example 5. The weight ratio of the nonionic surfactant of Example 1 to that of Example 5 was 4: 1.

Example 9

Example 1 was repeated with the exception that the surfactant was a blend of alcohol alkoxylate surfactant of Example 1 and the block copolymer nonionic surfactant of ethylene oxide and propylene oxide of Example 6. The weight ratio of the nonionic surfactant of Example 1 to that of Example 6 was 4:1.

Example 10

Example 1 was repeated with the exception that the surfactant was a blend of alcohol alkoxylate surfactant of Example 2 and the block copolymer nonionic surfactant of ethylene oxide and propylene oxide of Example 6. The weight ratio of the nonionic surfactant of Example 2 to that of Example 6 was 4:1.

Example 11

Example 1 was repeated with the exception that the surfactant was a blend of alcohol alkoxylate surfactant of Example 3 and the block copolymer nonionic surfactant of ethylene oxide and propylene oxide of Example 6. The weight ratio of the nonionic surfactant of Example 3 to that of Example 6 was 4:1.

The results observed in the foregoing Examples and Comparative Examples are reported in the TABLE hereafter.

TABLE

| | Temperature | SPRAY ARM EFFICIENCY (Percent) | | |
|---|---|---|---|---|
| Number | °F. | No Soil | Milk Soil | Egg Soil |
| Comparative | 90 | 98 | 91 | 78 |
| Example 1 | 140 | 99 | 95 | 79 |
| Comparative | 90 | 98 | 91 | 79 |
| Example 2 | 140 | 100 | 94 | 78 |
| Comparative | 90 | 96 | 89 | 76 |
| Example 3 | 140 | 98 | 94 | 79 |
| Comparative Example 4 | 90 | 61 | 51 | 45 |
| Comparative Example 5 | 90 | 66 | 46 | 35 |
| Comparative Example 6 | 90 | 70 | 69 | 54 |
| Example 7 | 90 | 96 | 90 | 77 |
| | 140 | 96 | 96 | 90 |
| Example 8 | 90 | 97 | 89 | 79 |
| | 140 | 98 | 96 | 90 |
| Example 9 | 90 | 97 | 90 | 90 |
| | 140 | 100 | 97 | 92 |
| Example 10 | 90 | 97 | 95 | 82 |
| | 140 | 100 | 98 | 92 |
| Example 11 | 90 | 94 | 89 | 87 |
| | 140 | 98 | 99 | 93 |

It will be noted that the nonionic surfactant blends of the present invention surprisingly exhibit improved properties. A spray arm efficiency of at least 70 is required for satisfactory dishwashing efficiency with increasingly higher numbers demonstrating increasing cleaning efficiency. It was found possible to include the surfactants of Comparative Examples 4 to 6 that exhibited extremely low spray arm efficiency values with the surfactants of Comparative Examples 1 to 3, and to surprisingly demonstrate improved efficiency for the surfactant blends particularly when operating at a higher temperature (e.g., 140° F.). Also, there was no significant efficiency loss and there was sometimes even an efficiency improvement at a lower operating temperature (e.g., 90° F.) An aqueous dishwashing composition is provided that efficiently can operate over a wider range of temperatures with a high level of cleaning and defoaming ability that provides the consumer better results even if somewhat erratic temperatures and/or protein soil are encountered within the dishwasher.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. A solid machine dishwashing composition suitable for use in water at a temperature of up to at least 140° F. in the absence of excessive foaming even in the presence of protein soil consisting essentially of approximately 1 to 10 percent by weight based upon the total weight of the composition of a blend of nonionic surfactants (i) and (ii), wherein (i) is an alcohol alkoxylate surfactant having a molecular weight of approximately 500 to 2,000 and the structural formula:

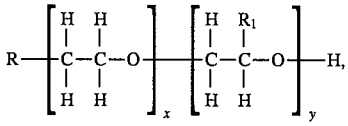

wherein R is an alkyl group of 6 to 18 carbon atoms, $R_1$ is a methyl group or an ethyl group, x is at least 3, and y is at least 2, and (ii) is a block copolymer of ethylene oxide and propylene oxide having a molecular weight of approximately 2,000 to 5,000 and the structural formula:

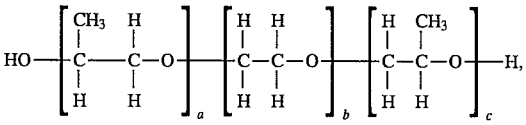

wherein a+c equals at least 20, and b is at least 20; wherein the weight concentration of nonionic surfactant (i) to nonionic surfactant (ii) in said blend of nonionic surfactants ranges from approximately 3 to 5:1 approximately 10 to 90 percent by weight based upon the total weight of the composition of at least one builder detergent; and approximately 0.5 to 50 percent by weight based upon the total weight of the composition of at least one compound that imparts germicidal and bleaching action containing active chlorine or available oxygen.

2. A solid dishwashing composition according to claim 1 wherein R of said nonionic surfactant (i) is an alkyl group of 8 to 10 carbon atoms.

3. A solid dishwashing composition according to claim 1 wherein $R_1$ of said nonionic surfactant (i) is a methyl group.

4. A solid dishwashing composition according to claim 1 wherein said nonionic surfactant (i) has a molecular weight of approximately 1,200 to 1,600.

5. A solid dishwashing composition according to claim 1 wherein said nonionic surfactant (i) has a molecular weight of approximately 1,400.

6. A solid dishwashing composition according to claim 1 wherein said nonionic surfactant (i) exhibits a cloud point of no more than approximately 20° C.

7. A solid dishwashing composition according to claim 1 wherein x is 3 to 12, and y is 2 to 18 in said nonionic surfactant (i).

8. A solid dishwashing composition according to claim 1 wherein R is an alkyl group of approximately 8 to 10 carbon atoms, $R_1$ is a methyl group, x is approximately 10 and y is approximately 14 in said nonionic surfactant (i), and the molecular weight is approximately 1,400.

9. A solid dishwashing composition according to claim 1 wherein nonionic surfactant (ii) has a molecular weight of approximately 3,000 to 4,000.

10. A solid dishwashing composition according to claim 1 wherein said nonionic surfactant (ii) has a molecular weight of approximately 3,200.

11. A solid dishwashing composition according to claim 1 wherein said nonionic surfactant (ii) exhibits a cloud point of approximately 30° to 50° C.

12. A solid dishwashing composition according to claim 1 wherein a+c is approximately 33, and b is approximately 29 in said nonionic surfactant (ii), and the molecular weight is approximately and 3,200.

13. A solid dishwashing composition according to claim 1 wherein a and c of said nonionic surfactant (ii) are substantially equal.

14. A solid dishwashing composition according to claim 1 wherein said units b derived from ethylene oxide of said nonionic surfactant (ii) are present in a concentration of approximately 30 to 50 percent by weight based upon the total weight of said nonionic surfactant (ii).

15. A solid dishwashing composition according to claim 1 wherein said units b derived from ethylene oxide of said nonionic surfactant (ii) are present in a concentration of approximately 40 percent by weight based upon the total weight of said nonionic surfactant (ii).

16. A solid dishwashing composition according to claim 1 wherein the weight concentration of nonionic surfactant (i) to nonionic surfactant (ii) in said blend of nonionic surfactants is approximately 4: 1.

17. A solid dishwashing composition according to claim 1 that is free of a phosphate ester defoamer.

18. A solid dishwashing composition according to claim 1 wherein said at least one compound that imparts germicidal and bleaching action is selected from the group consisting of chlorinated trisodium phosphate, trichlorocyanuric acid, sodium trichloroisocyanurate, the sodium salt of dichlorocyanuric acid, the potassium salt of dichlorocyanuric acid, sodium hypochlorite, 1,3-dichloro-5,5-dimethylhydantoin, and a peroxygen bleaching compound.

19. A solid machine dishwashing composition suitable for use in water at a temperature of up to at least 140° F. in the absence of excessive foaming even in the presence of protein soil consisting essentially of approximately 1 to 10 percent by weight based upon the total weight of the composition of a blend of nonionic surfactants (i) and (ii), wherein (i) is an alcohol alkoxylate surfactant having a cloud point of approximately 10° to 20° C., and a molecular weight of approximately 1,400 and the structural formula:

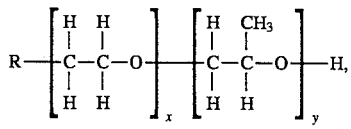

wherein R is an alkyl group of 8 to 10 carbon atoms, x is approximately 10, and y is approximately 14, and (ii) is a block copolymer of ethylene oxide and propylene oxide having a cloud point of approximately 30° to 50° C., and a molecular weight of approximately 3,200 and the structural formula:

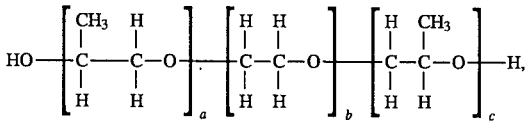

wherein a+c equals approximately 33, and b is approximately 29, and wherein the weight concentration of nonionic surfactant (i) to nonionic surfactant (ii) in said blend of nonionic surfactants is approximately 4: 1; approximately 10 to 90 percent by weight based upon the total weight of the composition of at least one builder detergent; and approximately 0.5 to 50 percent by weight based upon the total weight of the composition of at least one compound that imparts germicidal and bleaching action containing active chlorine or available oxygen.

20. A solid dishwashing composition according to claim 19 that is free of a phosphate ester defoamer.

21. A solid dishwashing composition according to claim 19 wherein said at least one compound that imparts germicidal and bleaching action is selected from the group consisting of chlorinated trisodium phosphate, trichlorocyanuric acid, sodium trichloroisocyanurate, the sodium salt of dichlorocyanuric acid, the potassium salt of dichlorocyanuric acid, sodium hypochlorite, 1,3-dichloro-5,5-dimethylhydantoin, and a peroxygen bleaching compound.

22. The process of washing food-soiled utensils in a machine dishwasher comprising contacting said utensils with an aqueous solution containing a concentration of about 0.1 to about 1.5 percent by weight of the composition of claim 1 at a washing temperature within the range of approximately 80° F. to approximately 140° F.

* * * * *